US006815597B1

(12) United States Patent
Bosley

(10) Patent No.: US 6,815,597 B1
(45) Date of Patent: Nov. 9, 2004

(54) PICKING INSTRUMENT FOR PICKING A STRING

(76) Inventor: Mark Bosley, 5523 Camden Ave., San Jose, CA (US) 95124

( * ) Notice: Subject to any disclaimer, the term of this patent is extended or adjusted under 35 U.S.C. 154(b) by 0 days.

(21) Appl. No.: 10/003,573

(22) Filed: Oct. 30, 2001

(51) Int. Cl.[7] ..... G10D 3/16
(52) U.S. Cl. ..... 84/322
(58) Field of Search ..... 84/322

(56) References Cited

U.S. PATENT DOCUMENTS 1,254,577 A * 1/1918 Carpenter et al. ..... 84/322
1,461,070 A * 7/1923 Budesyle ..... 84/322
2,484,820 A * 10/1949 Galetzky ..... 84/322
3,112,668 A 12/1963 Moshay ..... 84/322
3,595,118 A * 7/1971 Paxton ..... 84/322

FOREIGN PATENT DOCUMENTS

GB 2233141 * 1/1991

* cited by examiner

*Primary Examiner*—Shih-Yung Hsieh
(74) *Attorney, Agent, or Firm*—Haverstock & Owens LLP

(57) ABSTRACT

A pick having a substantially planar body surrounded by an edge, the pick comprising an aperture penetrating the planar body and a slot in communication between the aperture and a portion of the edge. The planar body includes two leaves, further wherein each leaf is located between the aperture with the slot and a remaining portion of the edge of the planar body, each leaf capable of moving substantially independent of one another. The pick further comprising a gripping feature configured on the planar body for allowing added gripping ability to the pick.

9 Claims, 1 Drawing Sheet

PICKING INSTRUMENT FOR PICKING A STRING

FIELD OF THE INVENTION

The present invention relates to picks, in general, and in particular, a pick for picking a string wherein the pick has an aperture and slot configuration for added flexibility.

BACKGROUND OF THE INVENTION

As known in the art, guitars, bass guitars, banjos, mandolins and other various stringed instruments can be played by picking the strings with a pick, otherwise known as a plectrum, which is usually held between the thumb and one of the forefingers of the hand.

Most of the existing picks are made of plastic, nylon, graphite or other materials. Although the existing picks have different configurations and are made of different materials, many picks are not flexible enough to allow for fast picking. Fast picking, for example, occurs in many bluegrass, rock and country songs which require the player to pick the strings at a very fast speed. Although the existing picks allow the player to pick at a fast speed, added flexibility in the pick will allow the player to acheive higher speeds, and therefore be more efficient. In addition, existing picks are typically rigid. Thus, a player using an existing pick can be caused to frequently drop the pick when picking the string, due to the inability of the pick to flex. One way to prevent the player from dropping the pick is to provide an aperture penetrating through a central portion of the pick and spaced apart from the edge in which the player's thumb and forefinger are in constant contact though the apreture. Such an object is disclosed in U.S. Pat. No. 3,112,668 to Moshay, hereinafter referred to Moshay.

In Moshay, as shown in FIG. 1, the pick's features include an aperture in the approximate center of the pick, which allows the player's thumb and forefinger to be in contact with each other. The configuration in Moshay allows the player to pick a string with a substantially rigid pick without any tendency for the pick to slip out of the grasp of the player. However, Moshay does not address a pick which has added flexibility based on the configuration of the aperture.

What is needed is a pick for picking a string having a configuration that allows the player's thumb and forefinger to be in contact with one another as well as incorporate added flexibility to allow the player to fast pick. What is also needed is a pick which is flexible enough to prevent it from slipping out from the player's hand when fast picking.

SUMMARY OF THE INVENTION

In one aspect of the invention, a pick has a substantially planar body surrounded by an edge. The pick comprises an aperture penetrating the planar body and a slot in communication between the aperture and a portion of the edge. The planar body includes two leaves, further wherein each leaf is located between the aperture with the slot and a remaining portion of the edge of the planar body. Each leaf is capable of moving substantially independently of one another. The pick further comprises a gripping feature configured on the planar body for allowing added gripping ability to the pick.

In another aspect, a substantially planar pick allows for picking a string, the substantially planar pick has a body, a pointed end and a rounded end positioned opposite of the pointed end. The pick has an aperture located substantially near a center of the body and extending therethrough. A slot is configured to pass from the rounded end to the aperture, wherein the slot is in communication with the aperture. The planar body includes two leaves, further wherein each leaf is configured between the slot and aperture and an edge between the rounded end and the pointed end, each leaf capable of moving substantially independent of each other. The pick further comprises a gripping feature which is configured on the planar body for allowing added gripping ability to the pick.

A pick has a body and a pointed end. The pick has an aperture located substantially near a center of the body and a slot which is configured to extend from the aperture to an edge of the body. Both the aperture and the slot pass through the body of the pick. The body includes two leaves. Each leaf is configured between the slot and aperture and a remaining edge of the body. Each leaf is capable of moving substantially independent of each other. The pick further comprises a gripping feature configured on the planar body for allowing added gripping ability to the pick.

Other features and advantages of the present invention will become apparent after reviewing the detailed description of the preferred embodiments set forth below.

DETAILED DESCRIPTION OF THE PREFERRED EMBODIMENT

Figure 1:
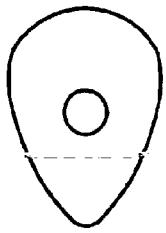
Fig. 1 (PRIOR ART)
FIG. 1 illustrates the prior art relating to picks.
Figure 2:
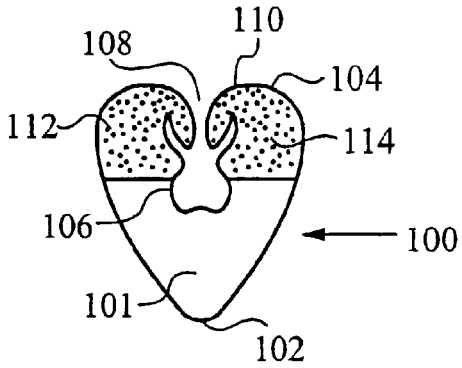
FIG. 2 illustrates a preferred embodiment of the pick in accordance with the present invention.

FIG. 2 illustrates a preferred embodiment of the pick in accordance with the present invention. FIG. 2 illustrates a substantially planar pick 100 which preferably has a heart-like shape body 101, as having a substantially pointed end 102 and a substantially rounded end 104. The rounded end 104 is configured on the opposite side of the body from the pointed end 102. The pick 100 has an aperture 106 which extends though the pick 100, whereby the aperture 106 is located through the planar body 101. The pick 100 also has a slot 108 which also extends through the body 101 passing from the aperture 106 completely through an edge. The slot is preferably configured to begin at the aperture 106 and traverse to the rounded end 104 of the body 101. For this example, the portion of the body 101 having the slot 108 is referred to as the upper portion, whereas the portion of the body 101 below the aperture 106 is referred to as the bottom portion. In operation, the player's thumb and forefinger are positioned on opposite faces of the body 101, preferably around the upper portion, and are touching each other through the aperture 106. This configuration allows the player to have a firm grip of the pick 100.

The slot 108 separates the upper portion of the body 101 into two halves or leaves 112 and 114 while maintaining the overall integrity of the lower portion of the body 101 as one piece. In addition, the slot 108, in conjunction with the aperture 106 removes a portion of the surface area within the body 101. Thus, the separation of the body 101 into leaves or halves 112 and 114 reduces rigidity in the upper portion of the body 101. The slot 108 allows each leaf 112 and 114 of the body 101 to move relative to or independent of one another.

When the player's thumb and forefinger are positioned about the upper portion of the body 101 and are in contact with one another through the aperture 106, there is a consistent force that is maintained on at least one of the leaves 112 and 114. When the player strikes one or more string, a force is created between the lower portion of the string which counters the force caused by the thumb and the forefinger. These counter-forces cause the upper portion and lower portion to bend, typically more than a standard pick. In addition, if the force between the thumb and forefinger is only present on one of the leaves, the counter-force caused from the string will compel the other leaf to bend away, thereby making the pick 100 even more flexible. Therefore, the slot 108 in communication with the aperture 106 typically causes the body 100 to be more flexible than a pick formed of similar material, types and weights.

It is preferred that the end of the slot 108 which traverses toward the rounded end 104 has a notch 110. The notch 110 aids in applying the pick 100 as a closure means for a bag. Additionally, the pick 100 is able to be pushed over the threads of a button and worn by a player until needed. In addition, the notch 110 with the slot 108 and aperture 106 creates a novelty guitar pick which would be used as a bag clip. For instance, complementary guitar picks would be used as bag clips which accompanying guitar magazines, T-shirts at a rock concert, etc.

Figure 3:
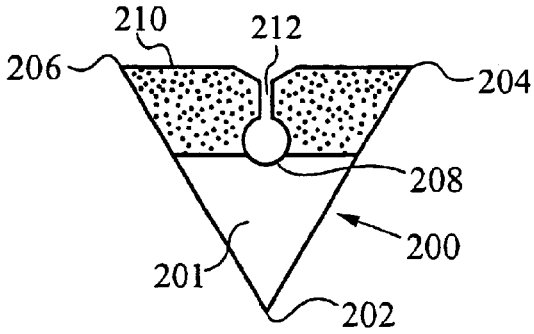
FIG. 3 illustrates an alternative embodiment of the pick in accordance with the present invention.
Figure 4:
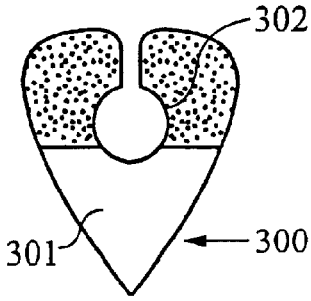
FIG. 4 illustrates an alternative embodiment of the pick in accordance with the present invention.

Alternatively, the pick 100 has any desired shape or size, as shown in FIG. 3. It should also be noted that the aperture 106 alternatively has any shape or be any size depending on the flexibility desired in the pick 100. For instance, the aperture 106 shown in FIG. 2 having a butterfly configuration will provide a more flexible pick 100, due to less surface area in the body 101. In contrast, as illustrated in FIG. 4 a rounded aperture 302 will provide more rigidity in the pick 300 due to more surface area being present in the body 301. Further, the shape of the aperture 106 and the slot 108 are able to be modified for aesthetic reasons. For example, the aperture 106 is able to have a silhouette of a guitar body (FIG. 2), a pineapple (not shown), etc. In addition, the pick 100 may have bumps (not shown), grooves (not shown), small apertures (not shown) or other grip enhancing features which allow the user to have added ability in gripping the pick 100.

FIG. 3 illustrates an alternative embodiment of the pick in accordance with the present invention. As shown in FIG. 3, the pick 200 has a triangular shaped-body 201 with three pointed ends 202, 204, 206. The pick 200 has an aperture 206 which extends though the pick 200, whereby the aperture 208 is located substantially near the center of the body 201. The pick 200 also has a slot 212 which also extends through the body 201. The slot is configured to begin at the aperture 208 and traverse to a predetermined point on an edge, wherein the edge is designated as 210. As stated above, the slot in conjunction with the aperture, provides flexibility to the pick 200 by separating a portion of the body 201 into two halves or leaves while maintaining the overall integrity of the body 201. In this alternative embodiment, the player uses either end 204 or 206 to pick the string for added flexbility in comparison to the end 202. As noted above, picking the string with end 202 provides flexiblity to the pick due to the force on the edge 210 caused by the player's thumb and forefinger. However, picking with end 204 or 206 adds more flexibility in the body 201, since the slot 212 has separated the body 201 into two halves. Thus, only half the rigidity in the body 201 is present when the player picks the string with end 204 and 206. It should be noted that this feature is able to be applied to the pick 100 in the preferred embodiment.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention.

What is claimed is:

1. A pick having a substantially planar body surrounded by an edge, the pick comprising an aperture penetrating the planar body and a slot in communication between the aperture and a portion of the edge, wherein the aperture is sized to receive a closed bag and the slot having a dimension sufficient to pass and also releasably secure the closed bag.

2. The pick according to claim 1 wherein the planar body includes two leaves, further wherein each leaf is located between the aperture with the slot and a remaining portion of the edge of the planar body, each leaf capable of moving substantially independent of one another.

3. The pick according to claim 1 further comprising a gripping feature configured on the planar body for allowing added gripping ability to the pick.

4. A substantially planar pick for picking a string, the substantially planar pick having a body, a pointed end and a rounded end positioned opposite of the pointed end, the pick having an aperture located substantially near a center of the body and extending therethrough, the pick having a slot configured to pass from the rounded end to the aperture, wherein the aperture is sized to receive a closed bag and the slot is in communication with the aperture and has a dimension sufficient to pass and also releasably secure the closed bag.

5. The substantially planar pick according to claim 4 wherein the planar body includes two leaves, further wherein each leaf is configured between the slot and aperture and an edge between the rounded end and the pointed end, each leaf capable of moving substantially independent of each other.

6. The pick according to claim 4 further comprising a gripping feature configured on the planar body for allowing added gripping ability to the pick.

7. A complementary guitar pick for promotional use having a body and an operational end, the pick having an aperture located substantially near a center of the body and a slot configured to extend from the aperture to an edge of the body, wherein both the aperture and the slot pass through the body of the pick, the aperture is sized to receive a closed bag, the bag for holding music related promotion items, and the slot having a dimension sufficient to pass and also releasably secure the closed bag.

8. The pick according to claim 7 wherein the body includes two leaves, further wherein each leaf is configured between the slot and aperture and a remaining edge of the body, wherein each leaf is capable of moving substantially independent of each other.

9. The pick according to claim 7 further comprising a gripping feature configured on the planar body for allowing added gripping ability to the pick.

* * * * *